United States Patent [19]

Hull

[11] Patent Number: 4,596,335

[45] Date of Patent: Jun. 24, 1986

[54] MARKING IMPLEMENT HOLDER

[76] Inventor: Richard P. Hull, 236 Roseland Ave., Essex Fells, N.J. 07021

[21] Appl. No.: 723,218

[22] Filed: Apr. 15, 1985

[51] Int. Cl.[4] ..... A47F 7/00

[52] U.S. Cl. ..... 211/69.1; 248/359

[58] Field of Search ..... 211/69.1–69.9, 211/60.1; 248/1, 359 E, 359 F, 117.1, 117.2, 313, 350, 520, 538; 224/218

[56] References Cited

U.S. PATENT DOCUMENTS

| | | | |
|---|---|---|---|
| D. 187,276 | 2/1960 | Poglien | 248/530 X |
| 755,870 | 3/1904 | Haywood | 211/69.7 |
| 891,099 | 6/1908 | Priester | 248/359 E X |
| 1,287,554 | 12/1918 | Wood | 211/69.8 |
| 1,439,067 | 12/1922 | Cole | 211/69.8 |
| 2,341,751 | 2/1944 | Willoughby | 248/188.9 |
| 2,591,805 | 4/1952 | Gossett | 211/70.6 X |
| 2,614,779 | 10/1952 | Peterson et al. | 248/359 E X |
| 3,047,262 | 7/1962 | Ripich | 248/538 |
| 3,195,267 | 7/1965 | Gehlen | 248/359 E X |
| 3,360,224 | 12/1967 | Baumann | 248/530 |
| 3,503,546 | 3/1970 | Hunt | 224/218 |
| 4,325,484 | 4/1982 | Berry | 211/60.1 X |

FOREIGN PATENT DOCUMENTS

| | | | |
|---|---|---|---|
| 648120 | 10/1962 | Italy | 211/69.6 |

*Primary Examiner*—Ramon S. Britts
*Assistant Examiner*—Sarah A. Lechok Eley
*Attorney, Agent, or Firm*—Hoffmann, Dilworth, Barrese & Baron

[57] ABSTRACT

The marking implement holder includes a guide arm and a support arm. The guide arm has a free end adapted to engage a marking surface and act as a guide when the holder is grasped and moved along the marking surface. The support arm extends from the guide arm and is spaced from the free end thereof. Mounting structure is on the support arm to removably affix a marking implement thereon in position to engage with the marking surface at a point spaced from the free end of the guide arm and in accordance with movement of the guide arm thereby providing freedom of hand movement while increasing visibility of the point of application of the marking implement to the marking surface.

16 Claims, 13 Drawing Figures

MARKING IMPLEMENT HOLDER

BACKGROUND OF THE INVENTION

There are certain inherent difficulties that occur when handling a pen, pencil or other writing implement. The same holds true for other types of marking implements such as paint brushes.

One problem involves the visibility of the proximity of the marking surface where the marking implement is being applied. It is common practice to grasp the marking implement approximately in that manner. Ones hand naturally blocks the area proximal to the point of application of the markings and obscures visibility.

Additionally, by requiring the user to grasp the marking implement adjacent to the marking tip, the freedom of movement of the marking implement is restricted. This results in the presence of a lack of total freedom for freehand "writing or drawing".

In respect to children in particular, the fact that they must hold the marking implement adjacent the tip which obscures their view of the writing surface causes the child to often adjust his hand position to an improper location to improve visibility.

A child will often move his head as well, in order to see what he is writing or drawing. Children will put their heads on the table surface to be able to see, and this results in poor penmanship and limits perspective.

There is also less guidance in the art of penmanship. The "old school" of pen and ink required the writing implement to be held in a certain way, and accordingly, care was required in order to produce an acceptable result. In contrast, with modern writing implements such as ball-point pens and the like, writing styles can be more carefree, casual and faster, and correspondingly, less controlled.

A further difficulty that often occurs with marking implements is that once use is complete, and reuse in not to occur for a period of time, the marking implement must be put aside until needed again. This can give rise to several problems. The marking implements are generally round, and thus, it is difficult to place them in a stable and secure position where they will remain out of the way. Additionally, the marking tips are often placed in a precarious position where they can inadvertently mark surfaces in an undesirable manner during non-use. It would clearly be desirable to provide a means for facilitating controlled positioning of the marking implement and its use so that it is retained in a non-deleterious out of the way position and yet is readily accessible for re-use. It should be supported so that it will not freely become displaced and lost or caused undesirable and unwanted markings on the marking surface.

SUMMARY OF THE INVENTION

With the above background in mind, it is among the primary objectives of the present invention to provide a marking implement holder designed to hold a variety of different types of marking implements including pens, pencils and brushes.

In one form, the holder is designed so that it has a guide arm and a support arm with means to mount the chosen marking implement on the support arm. The guide arm is spaced from the support arm and includes a guide tip for engagement with the marking surface at a point spaced from the marking tip of the implement to be applied to the marking surface. Grasping of the guide arm and guiding the guide arm along the marking surface in the manner to apply the appropriate indicia or other markings to the marking surface will cause the marking tip to accomplish those markings at the desired location. The fact that the hold is grasped at a point spaced from the marking tip provides unobscured visibility of the application of the marking tip to the marking surface. This spacing also provides the user total freedom for "free-hand" writing or drawing since the holder allows for more freedom and complete visibility of the marking tip of whatever instrument is being utilized.

It is also an object to provide a holder designed so that it can hold a variety of different types and sizes of marking instruments.

It is also an objective of the present invention to provide a guide arm with a freely movable guide tip to provide unrestricted movement of the holder in the marking operation. In one form this is accomplished by the use of a rollable ball mounted in the guide tip for engagement with the marking surface.

The holder of the present invention is particularly useful with school children in that it is designed to provide an improved means for teaching the child to properly grip the marking instrument while permitting the child full visibility of the marking operation. This avoids the difficulty of children obscuring their view of the writing tip of a pen or pencil, for example, due to holding an ordinary writing instrument incorrectly.

The holder of the present invention can be formed of a conventional commercially available smooth, plastic, metal material or other convenient substitute therefor.

In place of the rollable ball at the tip of the guide arm for engagement with the marking surface, a smooth rigid surface can be employed such as an arcuate projection on the guide arm.

It is contemplated that the guide arm can be formed with a configuration which facilitates ease of gripping and movement in the desired painting, writing or other marking action.

It is an objective to provide a unitary inexpensive integrally formed one piece marking implement holder with the guide arm and support arm forming the legs of a U-shaped holder.

It is an objective to provide the support arm with appropriate holding means for the marking instrument, for example, extending spring clips or projections, removable C-clamps or receiving apertures with appropriate set screws to hold the marking implement therein.

It is a further objective of the present invention to provide an alternative form of the marking implement holder with the guide being formed as a pair of diverging legs, each having a guide tip to engage the marking surface. Either of the two guide legs, the support arm or the marking implement mounted in the support arm is adapted to be grasped for moving the marking implement over the marking surface with the hand spaced from the proximity of the marking point.

It is contemplated that the support arm can be positioned so that the marking implement is mounted therein and forms a tripod with the two legs of the guide arm whereby the instrument and holder is self-supporting. Therefore, in addition to providing proper guidance during use, the combination can be set aside and positioned in an upright position during non-use.

It is also contemplated that the guide tips of the legs of the guide arm in this alternative form be provided with appropriate ball bearing or rounded surfaces for facilitating contact and movement across the marking surface.

Furthermore, the support arm of the alternative form of the invention is formed with an appropriate split ring resiliently expandable to hold a number of different size marking implements whether it be a pen, pencil, brush or other conventional type of marking implement.

In contrast to the above initially discussed embodiment, the alternative embodiment uses three points of contact with the marking surface instead of two. Otherwise, the alternative form is usable in a similar manner for achieving desirable results.

The embodiments of the present invention are adapted to be formed as integral or interconnected members of conventional commercially available low cost metal or plastic materials and can be formed in an efficient and inexpensive manner thus providing an economic mass produceable implement holder usable with a variety of different sizes, shapes and types of marking implements.

It should also be noted that in connection with the use of the various forms of the present invention with a paint brush as the marking implement, the artist has a much increased freedom of movement with the paint brush. For instance, the movement of the brush is not solely limited to the movement of the artist's hand. A fulcrum or stable platform is provided to guide movement.

It is also contemplated that the guide arm be provided with suitable grooves or depressions at predetermined locations on its surface to facilitate ease of proper gripping and improved penmanship. For example, grooves can be formed in the desired location and size to accommodate engagement by the writer's thumb and forefinger.

Furthermore, the angular relationship between the guide arm and the marking arm can be predetermined and prearranged to produce a selected writer angle when the device is grasped and used in the intended manner. This enables the user to maintain a proper angle between pen and paper and optimizes the use of the device as a writing instrument for artwork and letters.

In another form, the support arm can be formed of resident material so that the marking implement can be snapped into position in the support arm for use and then, upon introduction of a predetermined amount of pressure, snapped out of the support for replacement.

In summary, a marking implement holder is provided with a guide arm having a free end adapted to engage a marking surface and act as a guide when the holder is grasped and moved along the marking surface. A support arm extends from the guide arm and is spaced from the free end thereof. Mounting means is on the support arm to removably affix a marking implement thereon in position to engage with the marking surface at a point spaced from the free end of the guide arm thereby providing freedom of hand movement while increasing visibility of the point of application of the marking implement to the marking surface.

With the above objectives among others in mind, reference is made to the attached drawings.

DETAILED DESCRIPTION

The marking implement holder shown in the embodiments of FIGS. 1–13 are formed from any number of well known commercially available metal or plastic materials or any well known substitute therefor.

Figure 1:
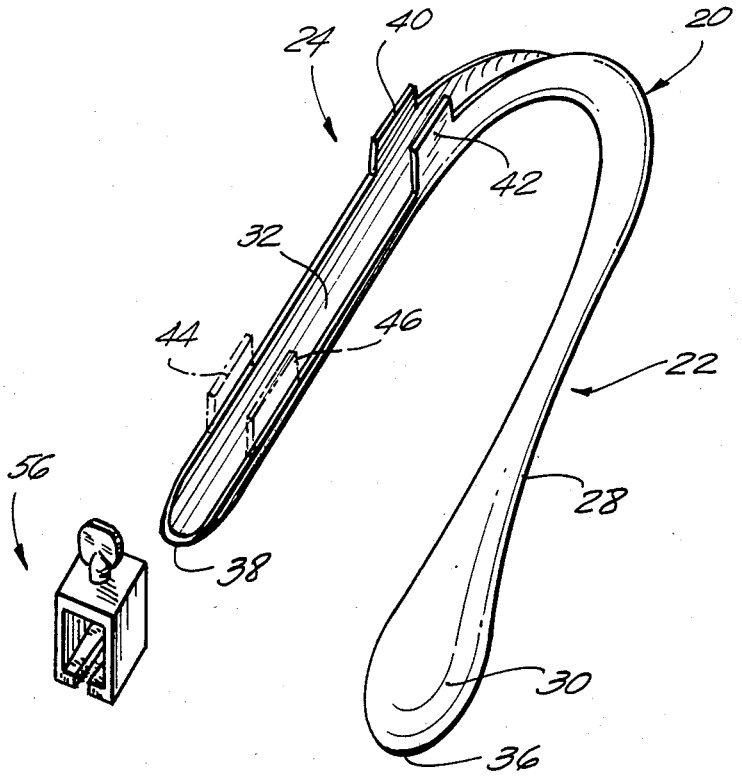
FIG. 1 is a perspective view of the marking implement holder of the invention and a separable U-type clamp adaptable for use in removably mounting a marking implement thereon.
Figure 2:
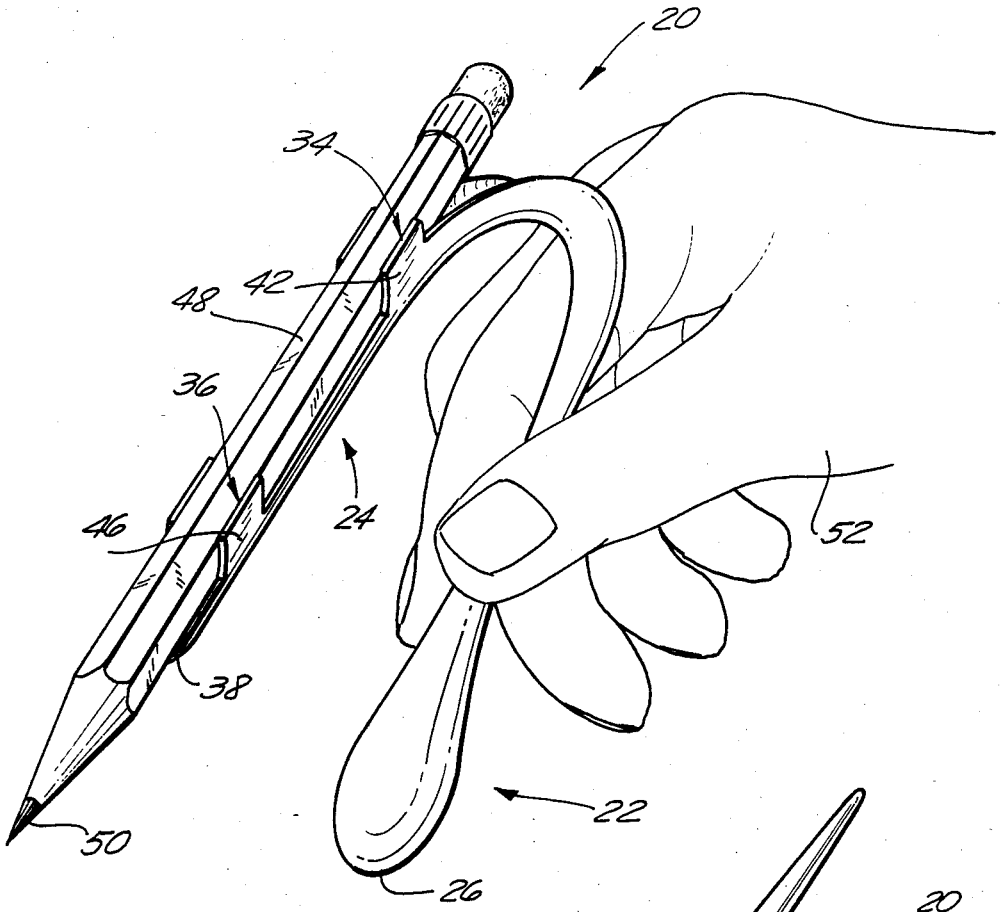
FIG. 2 is a perspective view of the marking implement holder of the invention with a pencil mounted thereon and the guide arm being grasped for use of the device.
Figure 3:
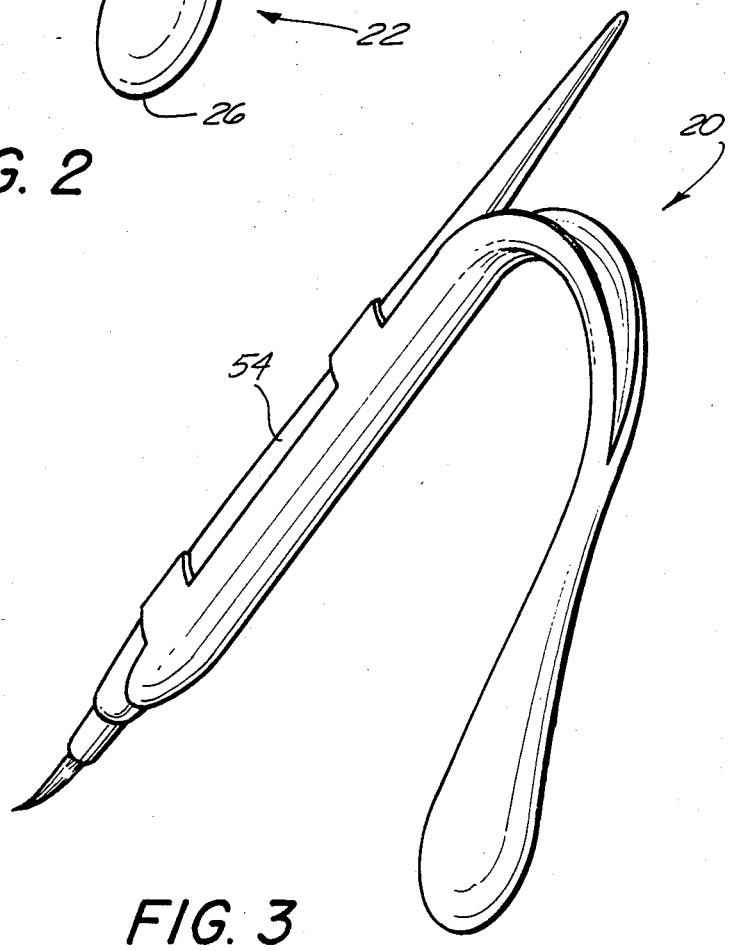
FIG. 3 is a perspective view thereof with a paint brush being mounted thereon.
Figure 9:
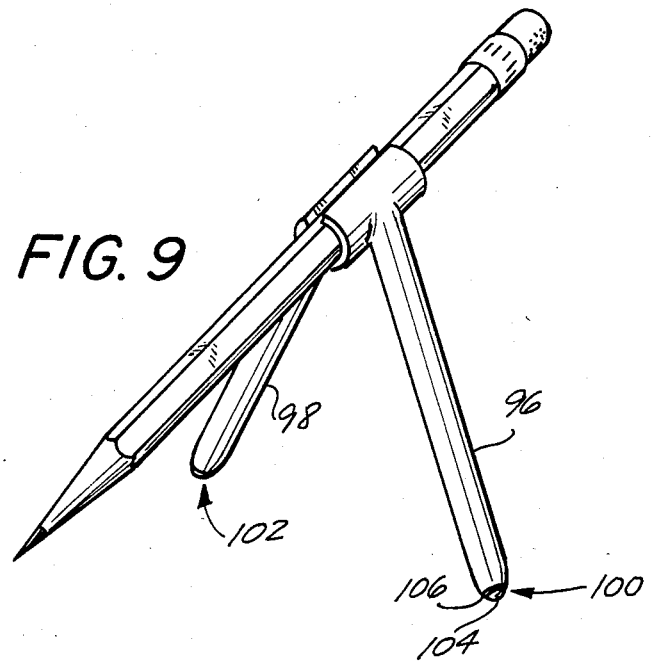
FIG. 9 is a perspective view thereof.
Figure 8:
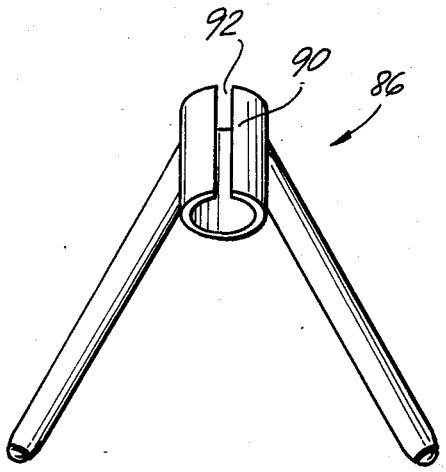
FIG. 8 is a front elevation view of a fourth alternative embodiment of the invention.
Figure 10:
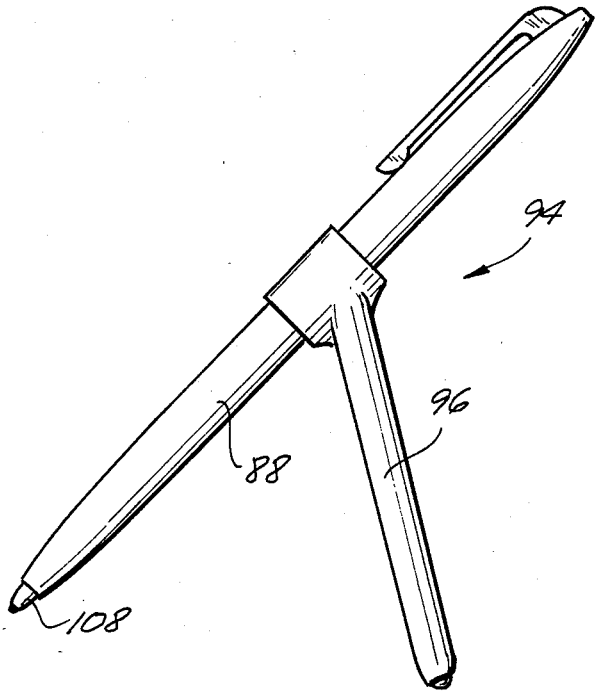
FIG. 10 is a side elevation view thereof with a pen type marking implement mounted thereon.

Holder 20 of FIG. 1–3 is U-shaped in configuration and includes a guide arm 22 and a support arm 24 extending from a common base and forming the legs of the U-shaped holder 20. The free end of guide arm 22 forms a guide tip 26 for engagement with the marking surface and act as a guide in the marking operation. The intermediate portion 28 of guide arm 22 is formed with an arcuate outer surface and is of narrower diameter that the enlarged portion 30 adjacent guide tip 26. This shape is a matter of choice and is designed to facilitate grasping and holding of the guide arm during use of the holder in the marking operation.

The support arm 24 is formed with an elongated longitudinally extending groove 32 in which the marking implement may be seated. Extending upward from the surface on which groove 32 is formed are a pair of spaced spring clips 34 and 36 which are integrally formed with the support arm 24. The spring clips 34 and 36 are resilient so that they can be expanded to grasp a variety of different size writing implements and hold them in position within groove 32 in the support arm with the tip of the writing implement extending beyond the free end 38 of the support arm. Clips 34 and 36 are spaced approximately along the length of the support arm so as to hold the marking implement in fixed position in the desired manner. The resilient nature of the spring clips 34 and 36 facilitate ease of introduction and removal of the marking implement. Spring clip 36 is formed by a pair of opposing projection tabs 44 and 46 for grasping of the marking implement. Similarly, springclip 34 is formed by a pair of opposing projection tabs 40 and 42.

In use, as shown in FIG. 2, a suitable marking implement, a pencil 48 is mounted on support arm 24. This is accomplished by applying appropriate pressure to displace the tabs of the spring clips 34 and 36 to position the pencil in groove 32 with its tip 50 extending beyond the free end 38 of support arm 24. The resilient nature of the clips 34 and 36 tending to return to the relaxed position will grasp and hold the pencil 48 in position. Marking tip 50 is then in position for applying appropriate indicia to the marking surface. It is spaced from and aligned with guide tip 26 on the end of the guide arm 22.

The user's hand 52 then grasps the guide arm at the comfortable location, intermediate portion 28 and by moving guide tip 26 appropriately across the marking surface, marking tip 50 on the pencil will apply the appropriate indicia to the marking surface.

It will be noted that the hand of the user 52 is free to grasp guide arm 22 in any desired manner without interferring with the visibility and freedom of movement of the tip 50 of marking pencil 48. The user has total freedom for "free-hand" writing.

The holder is extremely useful in many environments, for example, in teaching school children. It is designed to improve the child's grip as well as permitting the child full visibility in the area of the application of the written matter. In this manner, the danger of children obscuring their view of the writing tip of the pencil due to holding the pencil incorrectly is avoided.

The holder 20 is clearly also very useful in teaching handicapped children or adults or those with a learning disability since it is easier for all types of people to see what they are writing.

Movement of the guide tip 26 across the writing surface is also enchanced by the curved or ball shaped bulb at the end. This smooth surface facilitates freedom of movement across the marking surface.

After use, and when it is desirable to use a different type of marking implement, a small amount of applicable force is all that is necessary to remove pencil 48 from spring clips 34 and 36 and the holder can be reused with another type and size of marking implement, for example, paint brush 54 depicted in FIG. 3. Paint brush 54 is mounted in the same manner as pencil 48 and holder 20 with the paint brush thereon is used in the same manner as described in connection with the pencil 48. Thereafter, the paint brush 54 can be removed and a different marking implement substituted. Removal of pencil 48 or paint brush 54 or other marking implement used with holder 20 permits clips 34 and 36 to return to their relaxed position in condition for introduction of a further marking implement whereupon they will be expended to a gripping position.

Figure 6:
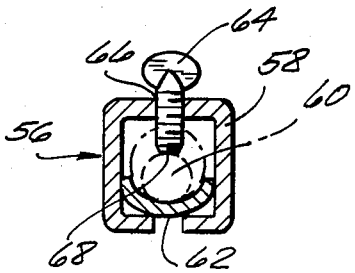
FIG. 6 is a sectional end view of a second alternative form of the holder showing the C-clamp of FIG. 1 holding a marking implement thereon.

Holder 20 can be modified in a number of ways without detracting from the general use and operation of the holder. For example, as shown in FIGS. 1 and 6, C-clamp 56 can be employed in place of one or more of the spring clips 34 and 36 in order to retain the marking implement on the support arm. The C-clamp can be formed of a conventional metal or plastic material and includes a C-shaped base 58 to surround a portion of the marking implement 60 positioned in groove 32 and to engage with the undersurface 62 of support arm 24. A threaded set screw 64 extends through aperture 66 in the C-shaped body until its end 68 engages the marking implement 60 and affixes it to the support arm.

The holder would then be utilized in the same manner as the above discussed embodiments in applying appropriate markings to the marking surface. The marking implement 60 can be removed by rotating set screw 64 in the opposite direction to free the marking implement and a different type or size of marking implement can be substituted for reuse of the holder.

Figure 4:
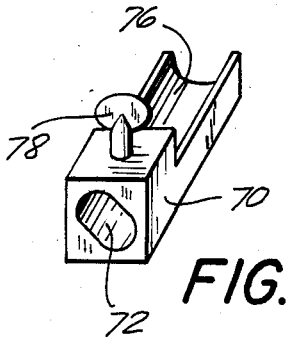
FIG. 4 is a fragmentary view of a first alternative embodiment of the holder showing the end portion of the support arm.
Figure 5:
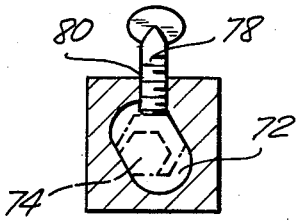
FIG. 5 is a sectional end view thereof.

Instead of a separable C-clamp, as shown in connection with FIGS. 1 and 6, the end portion 70 of the support arm can be formed as a solid element with a central aperture 72 therethrough. Aperture 72 would communicate with groove 32 as shown in FIGS. 4 and 5. The aperture 72 at the end of the support arm is adapted to receive the marking implement 74 therein which is inserted until it is in the desired position within groove 76 in the support arm. A threaded set screw 78 is then rotated so that it extends through aperture 80 in portion 70 and engages with the marking implement 74 to retain it in position. In all other respects, the holder of FIGS. 4 and 5 corresponds to holder 20 and is used in the same manner.

Alternatively, more than one solid portion 70 can be employed along the length of the support arm with each solid portion including an appropriate aperture and set screw through which the marking implement can be inserted and engaged and held in position. Removal of the marking implement is easily accomplished by rotating set screws 78 in the opposite direction and disengaging the marking implement 74 for removal through aperture 72.

Figure 7:
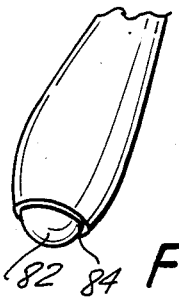
FIG. 7 is a fragmentary perspective view of a third alternative embodiment of the holding showing a ball bearing mounted in the end of the guide arm portion of the holder.

Alternatively, as shown in FIG. 7, the guide tip of holder 20 can be modified so that in a conventional manner a ball bearing or another type of rollable ball 82 can be rotatably mounted in a conventional manner within a receiving recess 84 in the end of the guide arm. This rolling ball 82 facilitates movement of the guide arm across the marking surface when the holder is in use. In all other respects as to structure and operation, the holder employing the ball 82 and recess 84 of FIG. 7 would be the same as holder 20 of FIG. 1.

A further alternative embodiment of the invention is shown as holder is designed to operate as a tripod when the marking implement such as pen 88 is mounted therein.

Holder 86 is formed of a single unitary member of conventional commercially available material such as plastic or metal or the like. Of course all of the embodiments of the present invention can be formed of more than one component, but it has been found to be economic to manufacture the holder as a single integral member.

In any event, in holder 86, the support arm is formed of a short resilient split tube 90. The split 92 in tube 90 permits resilient expansion upon insertion of pen 88 to resiliently hold it in fixed position during use. Thereafter, support arm 90 can be resiliently expanded to remove pen 88 and replace it by a different type and size of marking implement.

The guide arm 94 is in the form of a pair of diverging legs 96 and 98 which extend toward one another into engagement with support arm 90 at one end and away from one another toward free ends which form guide tips. Thus, guide tip 100 is formed at the free end of leg 96 and guide tip 102 is formed at the free end of leg 98. Each guide tip 102 and 100 is positioned to engage with the marking surface when holder 86 is being used and to form supports when holder 86 is being used and to form supports when holder 86 is not in use.

To facilitate movement of the legs 96 and 98 across the marking surface when holder 86 is being used, a ball bearing 104 is conveniently mounted in a recess 106 in guide tip 100 of leg 96 and similarly a ball bearing 104 is conventionally mounted in a recess 106 in guide tip 102 of leg 98. Rotation of balls 104 facilitates movement of the guide legs across the marking surface. Alternatively, as shown in connection with the embodiment of FIG. 1, the tips 100 and 102 can be formed with an integral spherical configuration in place of the ball bearings.

The marking tip 108 of the pen is located at the desired position by sliding pen 88 under the application of sufficient force to the appropriate location within support arm 90. The tip 108 along with the guide tips 100 and 102 form three points of contact for holder 86 in use. In this manner, the holder 86 with a marking implement mounted therein is designed to stand on its own, due to the "tripod" principle. Thus, in comparison to the above discussed embodiments where two points of contact are employed with the writing surface, the present embodiment of holder 86 utilizes three points of contact.

Use of holder 86 can be accomplished in a similar manner as discussed in connection with the above embodiments, that is by grasping the guide or support arm portions and moving the marking implement over the marking surface. The advantages are equally equivalent in that the grasping hand is spaced from the point of marking thus providing the desirable freedom of movement and visibility. Also, the holder 86 can be gripped in the desired manner without having to cope with possible obstruction of the marking surface.

After use, holder 86 with the marking implement such as pen 88 therein can be set aside and will be self-standing and ready for reuse at any desired time. There is no danger of inadvertent marking of the marking surfaces due to undesirable movement of the marking implement during non-use.

Pen 88 can be removed in a quick and efficient fashion by merely resiliently expanding tubular support arm 90 and removing the pen 88. Pen 88 can be replaced by another type and size of writing implement or by a paint brush.

Furthermore, in place of the resilient tubular C-ring 90 for the support arm, an appropriate C-clamp and set screw arrangement can be utilized as shown in FIGS. 1 and 6 or, as a further alternative, a solid support arm with an aperture therethrough and an appropriate set screw such as shown in connection with the embodiment of FIGS. 4 and 5.

Figure 11:
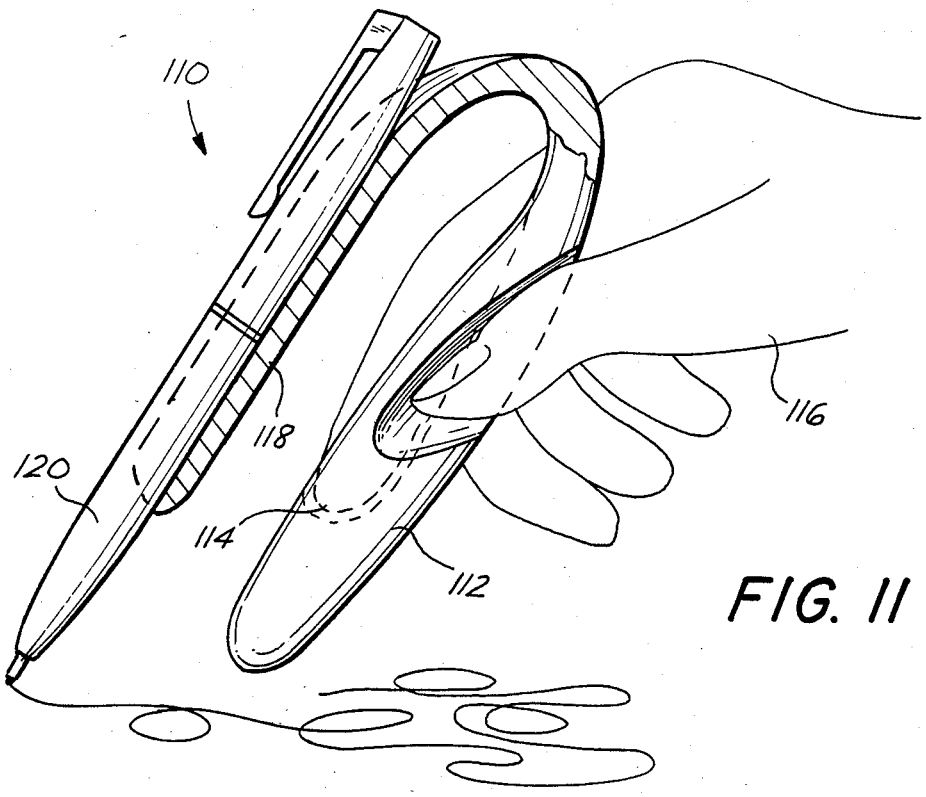
FIG. 11 is a perspective view of a fifth alternative embodiment of the holder with a pen mounted thereon and the guide arm being grasped for use of the device.

A further embodiment of the invention is depicted as holder 110 in FIG. 11. In this form, the integrally formed holder has a guide arm 112 containing suitable pre-formed grooves or depressions 114 located along its length. The grooves 114 are formed at the desired location for gripping of the guide arm by the user. For example, as shown, the thumb and forefinger of the user's hand 116 is gripping the marking holder's guide arm 112 at the locations of groove 114 for use.

The support arm 118 of holder 110 is curved on its outer surface to form an arcuate recess to receive a marking implement such as pen 120 therein. In the form of FIG. 11, at least the support arm 118 of holder 110 is formed of a resilient material so that pen 120 can be snapped into position on the guide arm. When it is desired to replace the pen 120, suitable force can be applied to the pen and it will be snapped out of position for replacement.

The angular relationship between support arm 118 and guide arm 112 is preselected so that a preferable writing angle is obtained with pen 120 when guide arm 112 is moved across the writing surface by the hand 116 of the user.

The provision of the suitable grooves or depressions at predetermined locations on the surface of guide arm 112 facilitates ease of proper gripping and improved penmanship. The angular relationship between the guide arm 112 and the support arm 118 is designed to produce a selected writer angle when the device is grasped and used in the intended manner. This enables the user to maintain a proper angle between pen and paper and optimizes the use of the device as a writing instrument for artwork and letters.

Simplicity and economy are enhanced by forming the support arm of resilient material so that the marking implement can be snapped into position on the support arm for use and then, upon introduction of a predetermined amount of pressure, snapped out of the support arm for replacement. In this manner, only an integral piece of material is required for the device 110 and there is no need for additional mounting components or structure.

Figure 13:
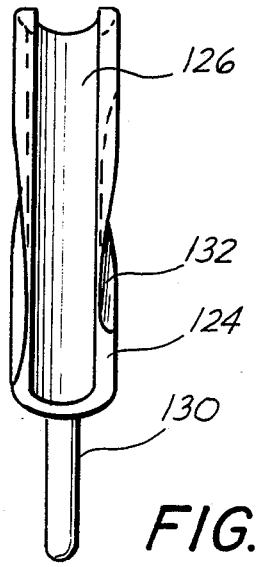
FIG. 13 is a front elevation view of the embodiment of FIG. 12 without a pen mounted thereon.
Figure 12:
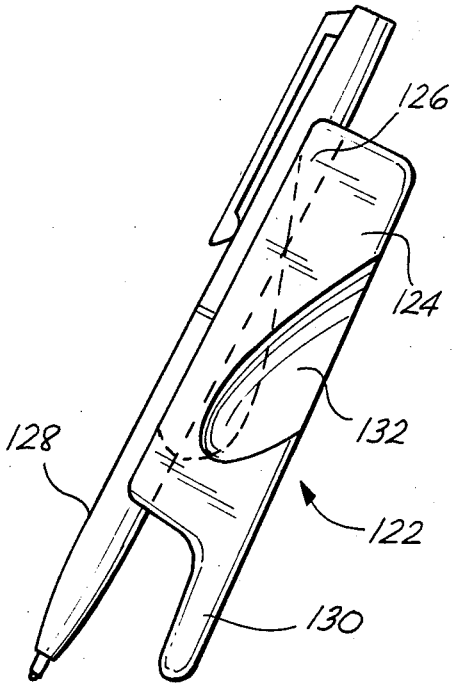
FIG. 12 is a side elevation view of a sixth alternative embodiment of the holder with a pen mounted thereon.

Another form of the device is depicted in FIGS. 12 and 13. In that form, holder 122 is consolidated in size. A substantially rectangular base portion 124 has an elongated recess 126 in one side to receive a marking implement such as pen 128. A projecting finger 130, extending from the opposing side of the base 124 from recess 126, forms the guide arm. The projecting finger 130 is substantially parallel to the end of pen 128 extending beyond recess 126. Again, the angles are arranged so that a preferred writer angle is produced as in connection with the embodiment of FIG. 11. Suitable depressions or grooves 132 are formed in base 124 to facilitate the gripping of the device by the user, for example, by the thumb and forefinger of the user's hand as shown in connection with the embodiment of FIG. 11. Again, similar to the embodiment of FIG. 11, at least a portion of holder 122 forming recess 126 is resilient to provide for the snap-in mounting of pen 128 in position. Application of suitable force will displace pen 128 for replacement at the desired time.

Use of devices 110 and 122 of FIGS. 11–13 is carried out in the same manner as in connection with the previously discussed embodiments. The writing implement or marker is snapped into position on the support arm and the user grasps the appropriate surface on the device containing the finger engagement grooves and proceeds to use the guide arm to trace the desired marking path on the marking surface. The writing point of the pen follows the action of the user and produces the corresponding indicia.

Thus the several aforenoted objects and advantages are most effectively attained. Although several somewhat preferred embodiments have been disclosed and described in detail herein, it should be understood that this invention is in no sense limited thereby and its scope is to be determined by that of the appended claims.

I claim:

1. A marking implement holder comprising; a guide arm having a free end adapted to engage a marking surface and act as a guide when the holder is grasped and moved along the marking surface, a support arm extending from the guide arm and spaced from the free end thereof, and mounting means on the support arm to removably affix a marking implement thereon in position to engage with the marking surface at a point spaced from the free end of the guide arm and in accordance with movement of the guide arm, the guide arm and support arm being arranged at predetermined spaced points so that, when the guide arm is grasped and moved with its free end following a path of desired indicia along the marking surface, the support arm and attached marking implement will follow the path of the support arm at a spaced unobstructed point therefrom to apply the desired indicia to the marking surface thereby providing freedom of hand movement while increasing visibility of the point spaced from the free end of the guide arm and in accordance with movement of the guide thereby providing freedom of hand movement while increasing visibility of the point of application of the marking implement to the marking surface and wherein said holder is of U-shaped configuration with the guide arm and the support arm extending from a common base to form the legs of the U-shaped member and wherein the guide arm is further formed with a configuration facilitating grasping and holding thereof and includes a first diameter portion intermediate its ends to be grasped and a second different diameter portion at its free end for engagement with the marking surface.

2. The invention in accordance with claim 1 wherein the holder is formed of a single integral member.

3. The invention in accordance with claim 1 wherein the guide arm is formed with a configuration facilitating grasping and holding thereof and includes a narrower diameter portion intermediate its ends to be grasped and a larger diameter portion at its free end for engagement with the marking surface.

4. The invention in accordance with claim 1 wherein the support arm includes a longitudinal groove at its surface to receive a portion of the marking implement therein with the end thereof extending beyond the free end of the support arm.

5. The invention in accordance with claim 4 wherein the mounting means includes at least one spring clip extending outwardly from the surface of the support arm to engage and hold the marking implement thereon.

6. The invention in accordance with claim 5 wherein there are two spring clips spaced along the length of the support arm.

7. The invention in accordance with claim 1 wherein the mounting means includes at least one removable C-clamp assembly engageable with the support arm and the marking implement to removably couple the marking implement to the support arm.

8. The invention in accordance with claim 7 wherein there are two C-clamp assemblies spaced from one another along the length of the support arm.

9. The invention in accordance with claim 1 wherein the mounting means include at least one receiving aperture along the length of the support arm to slidably receive the portion of the marking implement therein and at least one set screw associated with each receiving aperture to engage and hold the marking implement therein.

10. The invention in accordance with claim 1 wherein a rotatable ball is mounted in a recess in the free end of the guide arm for rolling engagement with the marking surface to facilitate movement of the guide arm thereover.

11. The invention in accordance with claim 1 wherein the marking implement is a writing utensil.

12. The invention is accordance with claim 1 wherein the marking implement is a brush.

13. The invention in accordance with claim 2 wherein the guide arm includes a plurality of grooves to receive the fingers of the user and facilitate grasping and handling of the marking implement holder.

14. The invention in accordance with claim 1 wherein the mounting means on the support arm includes forming at least a portion of the support arm of resilient material surrounding a receiving recess for the marking implement whereby the marking implement can be snapped into the receiving recess for use and removed therefrom by application of suitable force thereafter.

15. A marking implement holder comprising; a guide arm having a free end adapted to engage a marking surface and act as a guide when the holder is grasped and moved along the marking surface, a support arm extending from the guide arm and spaced from the free end thereof, and mounting means on the support arm to removably affix a marking implement thereon in position to engage with the marking surface at a point spaced from the free end of the guide arm and in accordance with movement of the guide arm thereby providing freedom of hand movement while increasing visibility of the point spaced from the free end of the guide arm and in accordance with movement of the guide arm thereby providing freedom of hand movement while increasing visibility of the point of application of the marking implement to the marking surface, the marking implement holder is substantially rectangular in configuration, a mounting recess on one side thereof to receive a marking implement therein and a guide finger extending from a portion of the holder spaced from the recess, the guide finger being substantially parallel to the marking portion of a marking implement mounted in the receiving recess on the holder, and finger gripping grooves formed in the holder to facilitate grasping thereof for use.

16. The invention in accordance with claim 1 wherein the support arm and the guide arm are arranged so that when the holder is grasped and the guide arm is utilized to move the holder along the marking surface, the marking implement mounted on the support arm will be at a desired angle with respect to the marking surface to facilitate optimizing of use of the device as a marking instrument.

* * * * *